United States Patent [19]

Ikeda et al.

[11] Patent Number: 4,707,463

[45] Date of Patent: Nov. 17, 1987

[54] HEAT SENSITIVE RECORDING MATERIAL

[75] Inventors: Haruhiko Ikeda; Shigetoshi Hiraishi, both of Tokyo, Japan

[73] Assignee: Mitsubishi Paper Mills, Ltd., Tokyo, Japan

[21] Appl. No.: 901,263

[22] Filed: Aug. 28, 1986

[30] Foreign Application Priority Data

| | | | |
|---|---|---|---|
| Aug. 28, 1985 | [JP] | Japan | 60-190224 |
| Sep. 2, 1985 | [JP] | Japan | 60-194565 |
| Dec. 26, 1985 | [JP] | Japan | 60-295600 |
| Dec. 28, 1985 | [JP] | Japan | 60-297936 |

[51] Int. Cl.[4] ..... B41M 5/18

[52] U.S. Cl. ..... 503/209; 427/150; 503/208; 503/225

[58] Field of Search ..... 346/208, 209, 225; 427/150–152

[56] References Cited

U.S. PATENT DOCUMENTS

| | | | |
|---|---|---|---|
| 3,957,288 | 5/1976 | Lemahieu et al. | 428/480 |
| 4,549,824 | 10/1985 | Sachdev et al. | 346/209 |

FOREIGN PATENT DOCUMENTS

| | | | |
|---|---|---|---|
| 0009827 | 1/1980 | Japan | 346/209 |
| 0244595 | 12/1985 | Japan | 346/208 |

*Primary Examiner*—Bruce H. Hess

*Attorney, Agent, or Firm*—Cushman, Darby & Cushman

[57] ABSTRACT

Heat-sensitive recording materials comprising a colorless or light-colored dye precursor and a color developer capable of developing a color of the dye precursor, upon reaction with said dye precursor with heating, further contain as sensitizers specific styryl-containing compounds. By incorporating these specific sensitizers, the heat-sensitive recording materials provide excellent thermal response and high sensitivity.

10 Claims, No Drawings

HEAT SENSITIVE RECORDING MATERIAL

BACKGROUND OF THE INVENTION

1. Field of the Invention

The present invention relates to highly sensitive heat-sensitive recording materials having excellent thermal response.

2. Description of the Prior Art

A heat-sensitive recording material comprises a support having provided thereon a heat-sensitive recording layer composed mainly of an electron donative, generally colorless or light-colored dye precursor and an electron accepting color developer. Upon heating with a thermal head, a thermal pen, a laser light, etc., the dye precursor instantaneously reacts with the color developer to give recording images and, such a system is disclosed in Published Examined Japanese Patent Application KOKOKU Nos. 4160/68, 14039/70, etc. Such a heat-sensitive recording material has been utilized over a wide range of fields such as a measuring recorder, a facsimile machine, a printer, a terminal of a computer, a label, a passometer, etc. because recording can be easily made using a relatively simple device, maintenance is easy, noise is not produced, etc. Particularly in facsimile machines, a great demand for heat-sensitive type continues to expand and at the same time, its speed is getting higher and higher because of necessity for reducing transmission costs. In response to such a high speed facsimile, demand for the high speed heat-sensitive recording materials is increasing.

In high speed facsimile machines, a current is repeatedly applied to a thermal head in such a very short period of time as less than several miliseconds because a standard original of a A-4 size is received and transmitted in a time period of several to 20 seconds and, the thermal energy generated thereby is transmitted to a heat-sensitive recording sheet in which a reaction for forming images is performed.

In order to perform the reaction for forming images by the thermal energy transmitted in such a short period of time, it is required that the heat-sensitive recording material be excellent in thermal response. To enhance the thermal response or reactivity, compatibility of a color developer with a dye precursor should be improved. For this purpose, senstizers are employed depending upon necessity. The sensitizers have an action to accelerate a color-forming reaction, by dissolving or enveloping therein dye precursors and color developers present around them when the sensitizers themselves melt with the transferred thermal energy. For increasing the sensitivity of a heat-sensitive recording material, it is also one technique to improve thermal response of the sensitizers or compatibility of the sensitizers with the dye precursors or color developers.

As such a technique, there are disclosed method for incorporating waxes in Published Unexamined Japanese Patent Application KOKAI No. 19231/73; nitrogen-containing compounds, carboxylic acid esters, etc. in Published Unexamined Japanese Patent Application KOKAI Nos. 34842/74, 149353/75, 106746/77, 5636/78, etc.; naphthol derivatives in Published Unexamined Japanese Patent Application KOKAI Nos. 64593/82 and 87094/84; naphthoic acid derivatives in Published Unexamined Japanese Patent Application KOKAI Nos. 64592/82, 185187/82, 191089/82 and 110289/83; and benzoic acid ester derivatives in Published Unexamined Japanese Patent Application KOKAI Nos. 148688/82, 182483/82, 112788/83 and 162379/83.

However, the heat-sensitive recording materials prepared by these methods are still insufficient for color density and color sensitivity. The present inventors have thus made investigations on various sensitizers with an attempt to obtain highly sensitive heat-sensitive recording materials having superior thermal response.

SUMMARY OF THE INVENTION

An object of the present invention is to provide heat-sensitive recording materials which are excellent in thermal response.

Another object of the present invention is to provide heat-sensitive recording materials having high sensitivity.

These objects of the present invention have been achieved by heat-sensitive recording materials comprising colorless or light-colored dye precursor and color developer capable of developing a color of the dye precursor upon reaction with the dye precursor with heating, characterized in that the heat-sensitive recording materials further contain compounds represented by general formula:

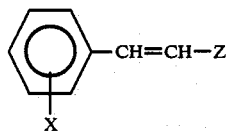

(I)

wherein X represents a member selected from the group consisting of a hydrogen atom, a halogen atom, a lower alkyl group and a lower alkoxy group; Z represents a member selected from the group consisting of:

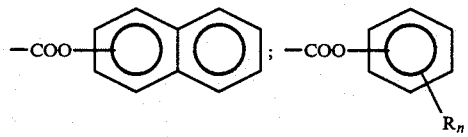

wherein R represents an alkyl group, a halogen atom, an alkoxy group, an acyloxy group or an acyl group and n represents 0 or an integer of 1 or 2;

—COSR' wherein R' represents a substituted or unsubstituted aryl group, or a substituted or unsubstituted aralkyl group; and,

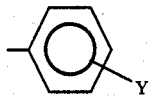

wherein Y represents a hydrogen atom, a halogen atom, a lower alkyl group or a lower alkoxy group.

PREFERRED EMBODIMENTS OF THE INVENTION

Of the compounds shown by general formula (I), preferred compounds are represented by the formulae (Ia), (Ib), (Ic) and (Id) below:

Compounds represented by the following formula (Ia):

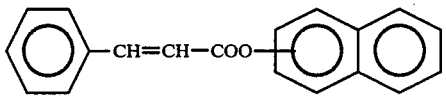

(Ia)

Compounds represented by formula (Ib):

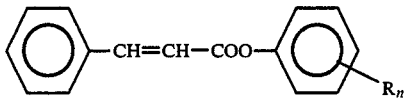

(Ib)

wherein R and n have the same significances as defined hereinabove.

Compounds represented by formula (Ic):

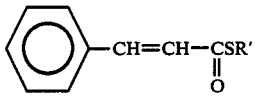

(Ic)

wherein R' has the same significance as defined hereinabove.

Compounds represented by formula (Id):

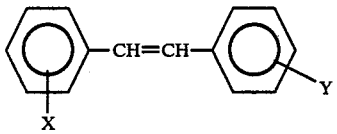

(Id)

wherein X and Y have the same significances as defined hereinabove.

The compounds represented by formulae (Ia), (Ib), (Ic) and (Id) can easily be prepared by known processes.

Specific example of the compounds represented by formulae (Ia), (Ib), (Ic) and (Id) which can preferably be used in the present invention include the following compunds.

(Ia):

| | |
|---|---|
| Compound (1) | 2-Naphthyl cinnamate |
| Compound (2) | 1-Naphthyl cinnamate |

(Ib):

Compound (3)

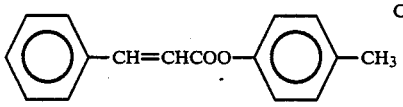

m.p. = 98–99° C.

Compound (4)

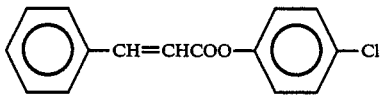

m.p. = 103–104° C.

Compound (5)

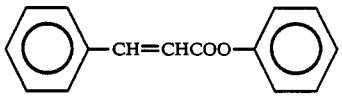

-continued m.p. = 76° C.

Compound (6)

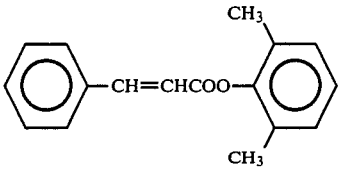

m.p. = 91–92° C.

Compound (7)

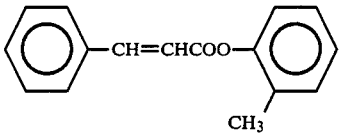

m.p. = 84–85° C.

Compound (8)

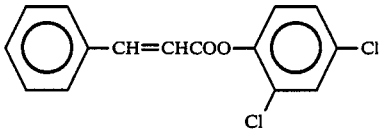

m.p. = 95° C.

Compound (9)

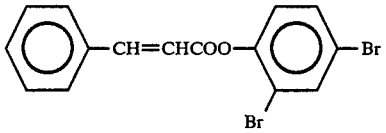

m.p. = 106° C.

Compound (10)

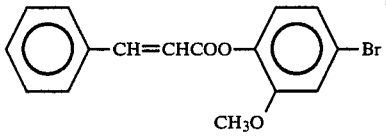

m.p. = 111° C.

Compound (11)

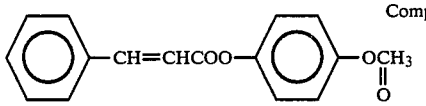

m.p. = 121–122° C.

Compound (12)

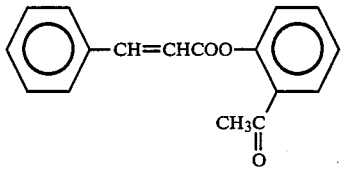

m.p. = 73° C.

Compound (13)

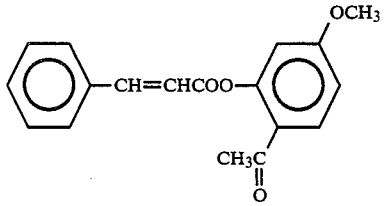

m.p. = 99° C.

-continued

Compound (14)

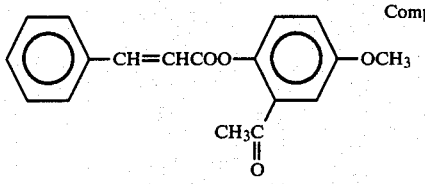

m.p. = 90° C.

(Ic):

Compound (15)

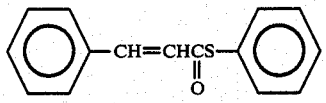

Compound (16)

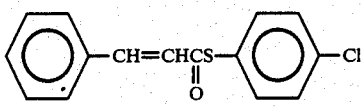

Compound (17)

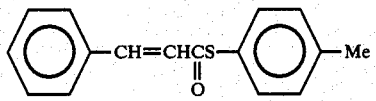

Compound (18)

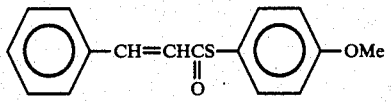

Compound (19)

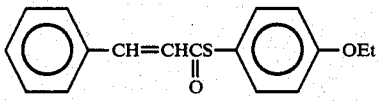

Compound (20)

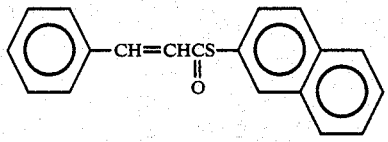

Compound (21)

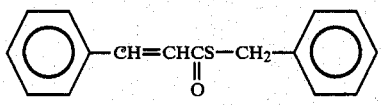

Compound (22)

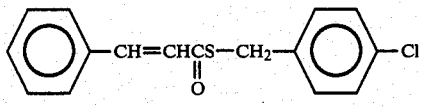

(Id):

Compound (23)

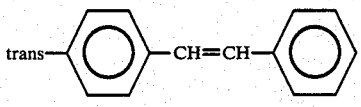

-continued

Compound (24)

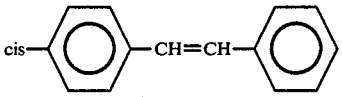

Compound (25)

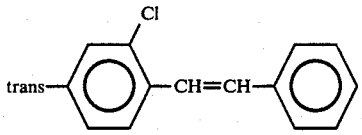

Compound (26)

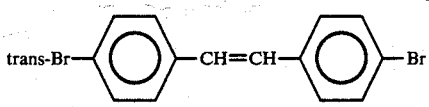

Compound (27)

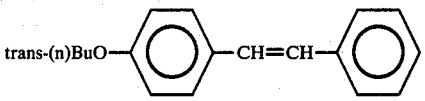

Compound (28)

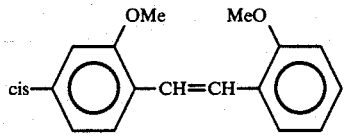

Compound (29)

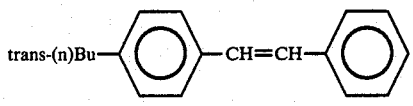

The sensitizer in accordance with the present invention is incorporated generally in an amount of 5 wt% or more, preferably 10 to 400 wt%, more preferably 20 to 300 wt%, based on the color developer. When the addition amount is less than 5 wt%, the effect of improving the sensitivity is insufficient and the addition amount exceeding 400 wt% sometimes results in economical disadvantage.

Major components which can be used in the heat-sensitive recording material of the present invention will be concretely described below but are not deemed to be limited thereto.

As the dye precursors there are triphenylmethane, fluorane, diphenylmethane, thiazine, spiropyrane compounds or the like.

Specific exampls of the dye precursors include 3,3-bis(p-dimethylaminophenyl)-6-dimethylaminophthalide, 3-(4-diethylamino-2-ethoxyphenyl)-3-(1-ethyl-2-methylindol-3-yl)-4-azaphthalide, 3-diethylamino-6-methyl-7-chlorofluorane, 3-diethylamino-7-chlorofluorane, 3-(N-cyclohexylamino)-7-methylfluorane, 3-diethylamino-7-methylfluorane, 3-diethylamino-6-chloro-7-methylfluorane, 3-diethylamino-7-anilinofluorane, 3-diethylamino-6-methyl-7-dibenzylaminofluorane, 3-(N-ethyl-N-p-toluidino)-7-anilinofluorane, 3-diethylamino-7-(o-chloroanilino)fluorane, 3-dibutylamino-7-(o-chloroanilino)fluorane, 3-diethylamino-6-methyl-7-anilinofluorane, 3-(n-ethyl-N-p-toluidino)-6-methyl-7-anilinofluorane, 3-(N-methyl-N-cyclohexylamino)-6-methyl-7-anilinofluorane, 3-piperidino-6-methyl-7-anilinofluorane, 3-pyrolidino-6-methyl-7-anilinofluorane, 3-diethylamino-7-(m-trifluoromethylanilino)fluorane, 3-(N-ethyl-N-isopentylamino)-6-methyl-7-anilinofluorane, 3-diethylamino-6-methyl-7-(p-phenetidino)-fluorane, 3-dibutylamino-7-(o-fluoroanilino)fluorane, etc.

As the color developers there are used acidic substances conventionally employed for heat-sensitive paper, namely, electron accepting compounds, especially phenol derivatives and aromatic carboxylic acid derivatives. Of the phenol derivatives, preferred are compounds having at least one phenolic hydroxy group. More preferred are phenol derivatives containing the phenolic hydroxy group, both or either of the orthopositions being unsubstituted. Specific examples of the phenol derivatives include phenol, p-t-butylphenol, p-phenylphenol, 1-naphthol, 2-naphthol, p-hydroxyacetophenone, 2,2'-dihydroxybiphenyl, 4,4'-isopropylidenediphenol, 4,4'-isopropylidenebis(2-t-butylphenol), 4,4'-isopropylidenebis(2-chlorophenol), 4,4'-cyclohexylidenediphenol, 2,2-bis(4-hydroxyphenyl)butane, 2,2-bis(4-hydroxyphenyl)pentane, 2,2-bis(4-hydroxyphenyl)hexane, methyl diphenolacetate, bis(4-hydroxyphenyl)sulfone, bis(3-allyl-4-hydroxyphenyl)-sulfone, 4-hydroxy-4'-methyldiphenylsulfone, 4-hydroxy-4'-isopropyloxydiphenylsulfone, bis(4-hydroxyphenyl)sulfide, 4,4'-thiobis(2-t-butyl-5-methyl)phenol, 1,7-bis(4-hydroxyphenylthio)-3,5-dioxyheptane, novolac type phenol resin, etc. Specific examples of the aromatic carboxylic acid derivatives include benzoic acid, p-t-butylbenzoic acid, p-hydroxybenzoic acid, methyl p-hydroxybenzoate, isopropyl p-hydroxybenzoate, benzyl p-hydroxybenzoate, lauryl gallate, stearyl gallate, salicylic anilide, 5-chlorosalicylic anilide; metals salts such as zinc 5-t-butylsalicylate, etc., metal salts such as zinc hydroxynapthoate, etc.

Examples of binders include water-soluble binders such as starches, hydroxyethyl cellulose, methyl cellulose, carboxymethyl cellulose, gelatin, casein, polyvinyl alcohol, modified polyvinyl alcohol, styrene-maleic anhydride copolymers, ethylene-maleic anhydride copolymers, etc.; latex type water-soluble binders such as styrene-butadiene copolymers, acrylonitrile-butadiene copolymers, methyl acrylate-butadiene copolymers, etc.

Examples of pigments include diatomaceous earth, talc, kaolin, calcined kaolin, calcium carbonate, magnesium carbonate, titanium oxide, zinc oxide, silicon oxide, aluminum hydroxide, urea-formalin resin, etc.

In addition, the heat-sensitive recording material may further contain higher fatty acid metal salts such as zinc stearate, calcium stearate, etc. and paraffin, oxidized paraffin, polyethylene, oxidized polyethylene, stearic acid amide, waxes such as castor wax, etc. for purposes of preventing abrasion of a head, sticking prevention, etc.; dispersing agents such as sodium dioctylsulfosuccinate, etc.; UV absorbents of benzophenone type, benzotriazole type, etc.; and further surfactants, fluorescent dyes, etc.

As supports used for the heat-sensitive recording material according to the present invention, paper is mainly used but various kinds of unwoven cloth, plastic films, synthetic paper, metal foils, etc. or composite sheets obtained using them in combination may also optionally be used.

The present invention will be described in more detail with reference to synthetic examples, examples and comparative examples below but is not deemed to be limited thereto.

SYNTHESIS EXAMPLE 1

Synthesis of 2-naphthyl cinnamate

In 70 ml of acetone was dissolved 6.4 g of 2-naphthol. A 25% queous sodium hydroxide solution was added to the solution. A solution of 8.1 g of cinnamoyl chloride in 10 ml of acetone was dropwise added to the mixture over 4 minutes while stirring. After the stirring was continued for 7 minutes, benzene and water were added to the system to effect liquid separation. After the organic phase was washed with an aqueous hydrogen sodium carbonate solution, the system was dried over anhydrous potassium carbonate and the solvent was distilled off. The residue was treated with n-hexane and benzene to give crystals of the product. The product was recrystallized from a solvent mixture of n-hexane and benzene to give 9.8 g of the product.

m.p. = 99°–101° C.

EXAMPLE 1

In a ball mill was dispersed 20 g of 3-diethylamino-6-methyl-7-anilinofluorane together with 80 g of a 1% aqueous polyvinyl alcohol solution. On the other hand, 50 g of 4,4'-isopropylidenediphenol was dispersed in a ball mill together with 200 g of 1% aqueous polyvinyl alcohol solution. Further 50 g of 2-naphthyl cinnamate obtained in Synthesis Example 1 was likewise dispersed together with 200 g of a 1% aqueous polyvinyl alcohol solution.

After these 3 dispersions were mixed, 250 g of a 40% calcium carbonate dispersion was added and, further 40 g of a 25% zinc stearate dispersion and 490 g of a 9.4% aqueous polyvinyl alcohol solution were added to the mixture. The resultant mixture was thoroughly stirred to make a coating solution. The coating solution was applied to base paper having a weight of 5.5 g/m$^2$ in a coated amount of 7 g/m$^2$ on solid basis, dried and treated with a super calender to give a heat-sensitive recording material.

COMPARATIVE EXAMPLE 1

A heat-sensitive recording material was prepared in a manner similar to Example 1 except that N-(hydroxymethyl)-stearic acid amide was used in place of 2-naphthyl cinnamate in Example 1.

COMPARATIVE EXAMPLE 2

A heat-sensitive recording material was prepared in a manner similar to Example 1 except that the 2-naphthyl cinnamate dispersion was omitted in Example 1.

EXAMPLE 2

A heat-sensitive recording material was prepared in a manner similar to Example 1 except that benzyl p-hydroxybenzoate was used in place of 4,4'-isopropylidenediphenol in Example 1.

COMPARATIVE EXAMPLE 3

A heat-sensitive recording material was prepared in a manner similar to Example 2 except thet the 2-naphthyl cinnamate dispersion was omitted in Example 2.

EVALUATION

Printing was made on the heat-sensitive recording materials obtained in Examples 1 and 2 and Comparative Examples 1 to 3 under conditions of 16.00 volts and 1.5 and 2.0 milliseconds. The optical density of each of the thus obtained color images was measured using a Macbeth RD 918 densitometer. The results are shown in Table 1 below.

TABLE 1

| | Color Density | |
|---|---|---|
| | 1.5 Milliseconds | 2.0 Milliseconds |
| Example 1 | 0.71 | 1.09 |
| Comparative Example 1 | 0.68 | 0.97 |
| Comparative Example 2 | 0.36 | 0.70 |
| Example 2 | 0.98 | 1.23 |
| Comparative Example 3 | 0.83 | 1.15 |

As in evident from the results shown in the table above, the heat-sensitive recording materials using the sensitizers in accordance with the present invention provide excellent thermal response and high sensitivity as compare to those obtained in the comparative examples.

SYNTHESIS EXAMPLE 2

Synthesis of Compound (3)

In 40 ml of acetone was dissolved 6.9 g of p-cresol and, 9.4 g of a 34% aqueous sodium hydroxide solution was added to the solution. A solution of 11.2 g of cinnamoyl chloride in 20 ml of acetone was dropwise added to the mixture over 10 minutes with stirring. After the stirring was continued for 7 minutes, benzene and water were added to the system to perform liquid separation. After the organic phase was washed with an aqueous hydrogen sodium carbonate solution, the system was dried over anhydrous potassium carbonate and the solvent was distilled off. The residue was treated with n-hexane to give crystals of the product. The product was recrystallized from n-hexane to give 11.0 g of the product.

m.p.=98°-99° C.

SYNTHESIS EXAMPLE 3

Synthesis of Compound (4)

In a manner similar to Synthesis Example 2, 10.4 g of the product was prepared except that 7.6 g of p-chlorophenol was used in place of 6.9 g of p-cresol in Synthesis Example 2.

m.p.=103°-104° C.

EXAMPLE 3

In a ball mill was dispersed 20 g of 3-diethylamino-6-methyl-7-anilinofluorane together with 80 g of a 1% aqueous polyvinyl alcohol solution. On the other hand, 50 g of 4,4'-isopropylidenediphenol was dispersed in a ball mill together with 200 g of 1% aqueous polyvinyl alcohol solution. Further 50 g of Compound (3) obtained above was likewise dispersed together with 200 g of a 1% aqueous polyvinyl alcohol solution.

After these 3 dispersions were mixed, 250 g of a 40% calcium carbonate dispersion was added and, further 40 g of a 25% zinc stearate dispersion and 490 g of a 9.4% aqueous polyvinyl alcohol solution were added to the mixture. The resultant mixture was thoroughly stirred to make a coating solution. The coating solution was applied to base paper having a weight of 55 g/m$^2$ in a coated amount of 7 g/m$^2$ on solid basis, dried and treated with a super calender to give a heat-sensitive recording material.

EXAMPLE 4

A heat-sensitive recording material was prepared in a manner similar to Example 3 except that Compound (4) was used in place of Compound (3) in Example 3.

COMPARATIVE EXAMPLE 4

A heat-sensitive recording material was prepared in a manner similar to Example 3 except that the dispersion of Compound (3) used in Example 3 was omitted.

COMPARATIVE EXAMPLE 5

A heat-sensitive recording material was prepared in a manner similar to Example 3 except that N-(hydroxymethyl)-stearic acid amide was used in place of Compound (3) in Example 3.

EXAMPLE 5

A heat-sensitive recording material was prepared in a manner similar to Example 3 except that benzyl p-hydroxybenzoate was used in place of 4,4'-isopropylidenediphenol in Example 3.

EXAMPLE 6

A heat-sensitive recording material was prepared in a manner similar to Example 5 except that Compound (4) was used in place of Compound (3) in Example 5.

COMPARATIVE EXAMPLE 6

A heat-sensitive recording material was prepared in a manner similar to Example 5 except that the dispersion of Compound (3) used in Example 5 was omitted.

EVALUATION

Printing was made on the heat-sensitive recording materials obtained in Examples 3 to 6 and Comparative Examples 4 to 6 under conditions of 16.00 volts and 1.5, 2.0 and 2.5 milliseconds. The optical density of each of the thus obtained color images was measured using a Macbeth RD 918 densitometer. The results are shown in Table 2 below.

TABLE 2

| | Color Density | | |
|---|---|---|---|
| | 1.5 Milliseconds | 2.0 Milliseconds | 2.5 Milliseconds |
| Example 3 | 0.91 | 1.19 | 1.29 |
| Example 4 | 0.90 | 1.17 | 1.25 |
| Comparative Example 4 | 0.36 | 0.70 | 0.95 |
| Comparative Example 5 | 0.68 | 0.97 | 1.15 |
| Example 5 | 1.02 | 1.27 | 1.30 |
| Example 6 | 1.01 | 1.22 | 1.27 |
| Comparative Example 6 | 0.83 | 1.15 | 1.23 |

As is evident from the results shown in the table above, the heat-sensitive recording materials using the sensitizers in accordance with the present invention provide excellent thermal response and high sensitivity as compared to those obtained in the comparative examples.

SYNTHESIS EXAMPLE 4

Synthesis of Compound (15)

To 40 ml of acetone was added 7.0 g of thiophenol and 11.3 g of a 28.3% aqueous sodium hydroxide solution was added to the solution. A solution of 11.1 g of cinnamoyl chloride in 20 ml of acetone was dropwise added to the mixture with stirring. After the stirring was continued, benzene and water were added to the system to perform liquid separation. After the organic phase was washed with an aqueous hydrogen sodium carbonate solution, the system was dried over anhydrous potassium carbonate and the solvent was distilled off. The residue was treated with n-hexane to give the product. The product was recrystallized from n-hexane and further recrystallized from ethanol to give 6.0 g of the product.

m.p.=88.5°-91.5° C.

Mass spectrum (FD method) m/e=240.

EXAMPLE 7

In a ball mill was dispersed 20 g of 3-diethylamino-6-methyl-7-anilinofluorane together with 80 g of a 1% aqueous polyvinyl alcohol solution. On the other hand, 50 g of 4,4'-isopropylidenediphenol was dispersed in a ball mill together with 200 g of 1% aqueous polyvinyl alcohol solution. Further 50 g of Compound (15) obtained above was likewise dispersed together with 200 g of a 1% aqueous polyvinyl alcohol solution.

After these 3 dispersions were mixed, 125 g of a 40% calcium carbonate dispersion was added and further 40 g of a 25% zinc stearate dispersion and 285 g of a 10.5% aqueous polyvinyl alcohol solution were added to the mixture. The resultant mixture was thoroughly stirred to make a coating solution. The coating solution was applied to base paper having a weight of 55 g/m$^2$ in a coated amount of 6 g/m$^2$ on solid basis, dried and treated with a super calender to give a heat-sensitive recording material.

COMPARATIVE EXAMPLE 7

A heat-sensitive recording material was prepared in a manner similar to Example 7 except that N-(hydroxymethyl)-stearic acid amide was used in place of Compound (15) in Example 7.

EVALUATION

Printing was made on the heat-sensitive recording materials obtained in Example 7 and Comparative Example 7 using a facsimile machine FACOM FAX-621C made by Fujitsu, Ltd. The optical density of each of the thus obtained color images was measured using a Macbeth RD 514 densitometer. The results are shown in Table 3 below.

TABLE 3

| | Color Density |
|---|---|
| Example 7 | 0.85 |
| Comparative Example 7 | 0.68 |

As is evident from the results shown in the table above, the heat-sensitive recording material using the sensitizer in accordance with the present invention provides excellent thermal response and high sensitivity as compared to that obtained in the comparative example.

EXAMPLE 8

In a ball mill was dispersed 20 g of 3-diethylamino-6-methyl-7-anilinofluorane together with 80 g of a 1% aqueous polyvinyl alcohol solution. On the other hand, 50 g of 4,4'-isopropylidenediphenol was dispersed in a ball mill together with 200 g of 1% aqueous polyvinyl alcohol solution. Further 50 g of Compound (23) was likewise dispersed together with 200 g of a 1% aqueous polyvinyl alcohol solution.

After these 3 dispersions were mixed, 125 g of a 40% calcium carbonate dispersion was added and, further 40 g of a 25% zinc stearate dispersion and 285 g of a 10.5% aqueous polyvinyl alcohol solution were added to the mixture. The resultant mixture was thoroughly stirred to make a coating solution. The coating solution was applied to base paper having a weight of 55 g/m$^2$ in a coated amount of 6 g/m$^2$ on solid basis, dried and treated with a super calender to give a heat-sensitive recording material.

COMPARATIVE EXAMPLE 8

A heat-sensitive recording material was prepared in a manner similar to Example 8 except that the dispersion of Compound (23) used in Example 8 was omitted.

EVALUATION

Printing was made on the heat-sensitive recording materials obtained in Example 8 and Comparative Example 8 using a facsimile machine FACOM FAX-621C made by Fujitsu, Ltd. The optical density of each of the thus obtained color images was measured using a Macbeth RD 514 densitometer. The results are shown in Table 4 below.

TABLE 4

| | Color Density |
|---|---|
| Example 8 | 0.79 |
| Comparative Example 8 | 0.23 |

As is evident from the results shown in the table above, the heat-sensitive recording material using the sensitizer in accordance with the present invention provides excellent thermal response and high sensitivity as compared to that obtained in the comparative example.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a colorless or light-colored dye precursor and a color developer capable of developing a color of said dye precursor upon reaction with said dye precursor with heating, said heat-sensitive recording material further containing a compound represented by general formula:

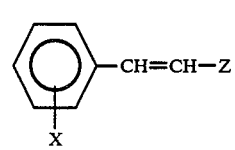

(I)

wherein X represents a member selected from the group consisting of a hydrogen atom, a halogen atom, a lower alkyl group and a lower alkoxy group; Z represents a member selected from the group consisting of:

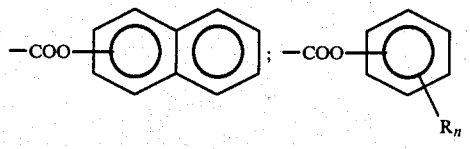

wherein R represents an alkyl group, a halogen atom, an alkoxy group, an acyloxy group or an acyl group and n represents 0 or an integer of 1 or 2;

—COSR' wherein R' represents a substituted or unsubstituted aryl group, or a substituted or unsubstituted aralkyl group; and,

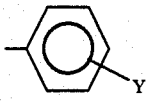

wherein Y represents a hydrogen atom, a halogen atom, a lower alkyl group or a lower alkoxy group.

2. A heat-sensitive recording material according to claim 1 wherein said compound of general formula (I) is a compound represented by formula:

(Ia)

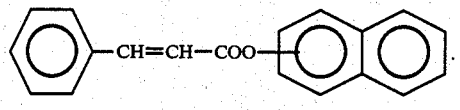

3. A heat-sensitive recording material according to claim 2 wherein said compound is 2-naphthyl cinnamate.

4. A heat-sensitive recording material according to claim 1 wherein said compound of general formula (I) is a compound represented by formula:

(Ib)

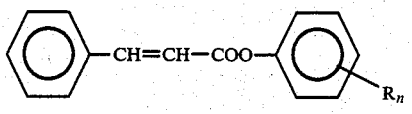

wherein R and n have the same significances as defined hereinabove.

5. A heat-sensitive recording material according to claim 4 wherein said compound is

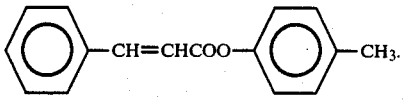

6. A heat-sensitive recording material according to claim 4 wherein said compound is

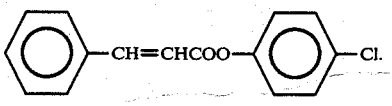

7. A heat-sensitive recording material according to claim 1 wherein said compound of general formula (I) is a compound represented by formula:

(Ic)

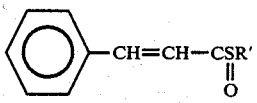

wherein R' has the same significance as defined hereinabove.

8. A heat-sensitive recording material according to claim 7 wherein said compound is

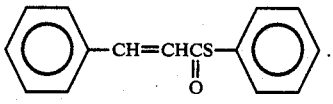

9. A heat-sensitive recording material according to claim 1 wherein said compound of general formula (I) is a compound represented by formula:

(Id)

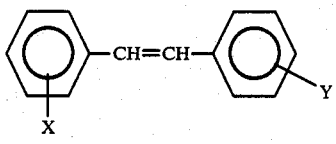

wherein X and Y have the same significances as defined hereinabove.

10. A heat-sensitive recording material according to claim 9 wherein said compound is

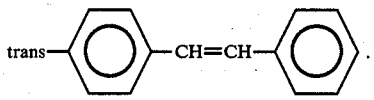

* * * * *